US007754986B1

(12) United States Patent
Niblock et al.

(10) Patent No.: US 7,754,986 B1
(45) Date of Patent: Jul. 13, 2010

(54) MECHANICAL SWITCH THAT REDUCES THE EFFECT OF CONTACT RESISTANCE

(75) Inventors: Trevor Niblock, Santa Clara, CA (US); Roozbeh Parsa, San Jose, CA (US); Peter J. Hopper, San Jose, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 638 days.

(21) Appl. No.: 11/711,523

(22) Filed: Feb. 27, 2007

(51) Int. Cl.
*H01H 57/00* (2006.01)

(52) U.S. Cl. ..... 200/181; 335/78

(58) Field of Classification Search ..... 200/181; 335/78

See application file for complete search history.

(56) References Cited

U.S. PATENT DOCUMENTS 2,999,910 A * 9/1961 Cooley ..... 200/52 R
6,057,520 A * 5/2000 Goodwin-Johansson .... 200/181
6,731,492 B2 * 5/2004 Goodwin-Johansson .... 361/233
7,053,737 B2 * 5/2006 Schwartz et al. ..... 335/78
7,501,920 B2 * 3/2009 Yuba et al. ..... 335/78
7,602,261 B2 * 10/2009 Chou et al. ..... 333/105
7,602,266 B2 * 10/2009 Menard et al. ..... 335/78
7,609,136 B2 * 10/2009 Wang et al. ..... 335/78

OTHER PUBLICATIONS

Tsung-Kuan A. Chou, et al., "Billion-Cycle ULV Electrostatic RF MEMS Switch", Solid-State Sensors, Actuators, and Microsystems Workshop, Jun. 4-8, 2006, pp. 78-81.

Han S. Lee, et al., "Micro-Electro-Mechanical Relays—Design Concepts and Process Demonstrations" Proceedings of the 50th IEEE Holm Conference on Electrical Contacts and the 22nd International Conference on Electrical Contacts, Sep. 20-23, 2004, pp. 242-247.

Tyco Electronics Corporation—P & B, Application Note, "Contact Arc Phenomenon", [online], [retrieved on Aug. 4, 2006]. Retrieved from the Internet: <URL:http://relays.tycoelectronics.com/appnotes/app_pdfs/13c3203.pdf>. pp. 1-3.

* cited by examiner

*Primary Examiner*—Michael A Friedhofer
(74) *Attorney, Agent, or Firm*—Mark C. Pickering

(57) ABSTRACT

A switch structure substantially reduces the effect of contact resistance by placing two mechanical switches in parallel between a source and a load, and sequentially closing and opening the mechanical switches so that one switch closes before the other switch, and opens after the other switch. The switch structure with the two mechanical switches can be realized with standard micro machined switches or as a micro-electromechanical system (MEMS) cantilever switch.

18 Claims, 8 Drawing Sheets

MECHANICAL SWITCH THAT REDUCES THE EFFECT OF CONTACT RESISTANCE

BACKGROUND OF THE INVENTION

1. Field of the Invention

The present invention relates to mechanical switches and, more particularly, to a mechanical switch that reduces the effect of contact resistance.

2. Description of the Related Art

A switch is a well known electrical device that provides a low-impedance electrical pathway when the switch is "closed," and a high-impedance electrical pathway when the switch is "opened." A mechanical switch is a type of switch where the low-impedance electrical pathway is formed by physically bringing two electrical contacts together, and the high-impedance electrical pathway is formed by physically separating the two electrical contacts from each other.

Many mechanical switches fail over time from a problem known as contact erosion, which is the transfer of contact material from a first electrical contact to a second electrical contact. Contact erosion occurs just as two electrical contacts come together, and just as the two electrical contacts come apart.

Just as two electrical contacts come together, when the voltage across the two electrical contacts is large enough, the air in the gap between the two electrical contacts ionizes, and an electron current in the form of an arc flows from the electrical contact with the lower potential to the electrical contact with the higher potential.

The electron current instantly causes the two electrical contacts to melt and/or oxidize which, in the case of melting, results in a migration of the contact material, such as metal, from one electrical contact to the other electrical contact. In the case of the oxidization of the contacts, this will lead to contact resistance dependent on the conductance of the oxide and its thickness. The migration of material adds a contact resistance to the switch, and eventually leaves the first electrical contact without enough material to physically touch the second electrical contact, thereby leading to device failure.

In some applications, such as audio and video applications, the addition of a contact resistance to the switch can cause a significant deterioration in the signal that passes through the switch. In these cases, the contact resistance limits the effective lifetime of the switch to a period that is well less than the physical lifetime of the switch (when the two electrical contacts can no longer touch).

In a similar manner, just as the two electrical contacts come apart, when the voltage across the two electrical contacts is large enough, the current density increases dramatically. The increased current density melts the two electrical contacts which, in turn, results in a migration of the contact material from one electrical contact to the other electrical contact. As before, the migration of material adds a contact resistance to the switch, and leads to the eventual failure of the switch.

Thus, a contact resistance can develop when the switch opens as well as when the switch closes. As a result, there is a need for a mechanical switch that reduces the effect of contact resistance, thereby increasing the lifetime of the switch for applications which are sensitive to the addition of a contact resistance.

BRIEF DESCRIPTION OF THE DRAWINGS

FIGS. 5A-16A and 5B-16B are a series of views illustrating a method of forming MEMS switch 300 in accordance with the present invention. FIGS. 5A-16A are a series of plan views, and FIGS. 5B-16B are a series of cross-sectional views taken along lines 5B-16B in FIGS. 5A-16A, respectively.

DETAILED DESCRIPTION OF THE INVENTION

Figure 1:
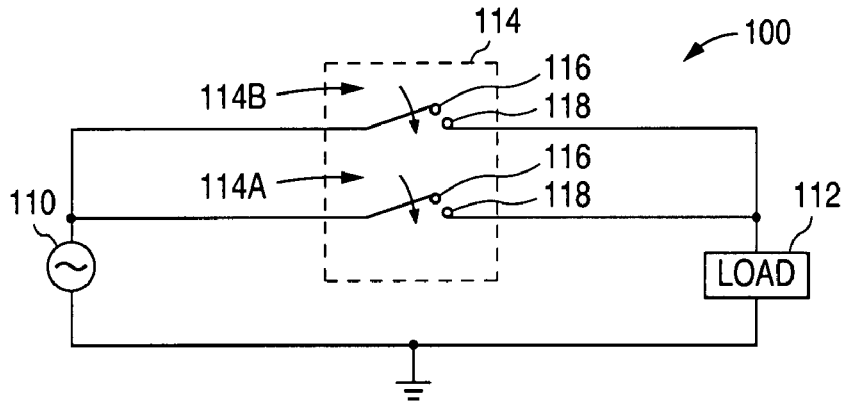
FIG. 1 is a circuit diagram illustrating an example of a circuit 100 in accordance with the present invention.

FIG. 1 shows a circuit diagram that illustrates an example of a circuit 100 in accordance with the present invention. As described in greater detail below, circuit 100 includes a switch structure that substantially reduces the effect of contact resistance by placing two mechanical switches in parallel, and sequentially closing and opening the mechanical switches.

As shown in FIG. 1, circuit 100 includes an alternating current (AC) voltage source 110, a load 112, and a switch structure 114 that connects voltage source 110 to load 112. In accordance with the present invention, switch structure 114 includes a first mechanical switch 114A and a second mechanical switch 114B that are connected in parallel. As a result, both switches 114A and 114B have a first electrical contact 116 connected to voltage source 110, and a second electrical contact 118 connected to load 112.

In operation, when switch structure 114 closes, first mechanical switch 114A closes first. After first mechanical switch 114A has completely closed, second mechanical switch 114B closes second. As in a conventional case, over time, first mechanical switch 114A suffers from contact resistance. The addition of contact resistance to a switch can be modeled as a switch resistance.

Figure 2:
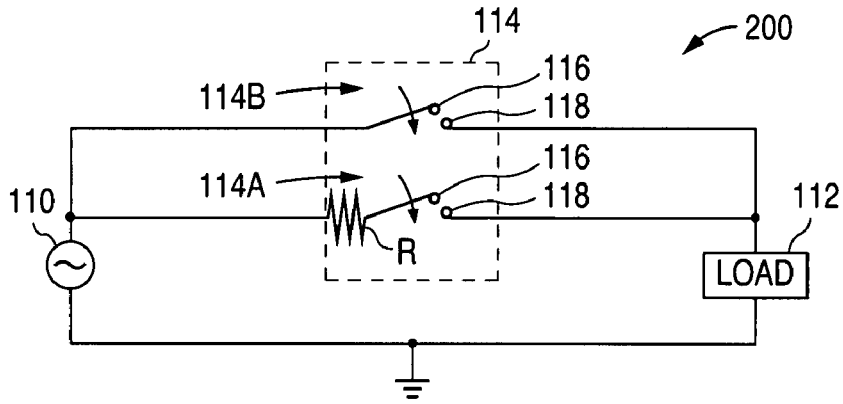
FIG. 2 is a circuit diagram illustrating an example of a circuit 200 in accordance with the present invention.

FIG. 2 shows a circuit diagram that illustrates an example of a circuit 200 in accordance with the present invention. Circuit 200 is similar to circuit 100 and, as a result, utilizes the same reference numbers to designate the elements that are common to both circuits. Circuit 200, which represents circuit 100 after a period of time, differs from circuit 100 with the inclusion of a switch resistance R that represents the effect of contact resistance.

In accordance with the present invention, first mechanical switch 114A protects second mechanical switch 114B from degradation due to contact resistance, and second mechanical switch 114B shorts out first mechanical switch 114A to provide an electrical pathway that is free of contact resistance.

Unlike first mechanical switch 114A, second mechanical switch 114B is initially free of contact resistance. Initially, when second mechanical switch 114B closes, there is no voltage drop across the electrical contacts 116 and 118 of second mechanical switch 114B because first mechanical switch 114A has already closed. If there is no voltage drop across the electrical contacts 116 and 118 of second mechanical switch 114B, then no contact resistance can develop. Thus, first mechanical switch 114A protects second mechanical switch 114B from degradation due to contact resistance as second mechanical switch 114B is closing.

In addition, since second mechanical switch 114B shorts out first mechanical switch 114A and provides an electrical pathway that is free of contact resistance, the increasing switch resistance R in FIG. 2 that occurs over time due to the increasing contact resistance of first mechanical switch 114A is effectively removed from the circuit.

Thus, even though the switch (contact) resistance R of first mechanical switch 114A may have substantially increased over time to the point of where significant signal deterioration has occurred, second mechanical switch 1146 shorts out the switch (contact) resistance R and effectively removes it from the circuit.

The development of contact resistance can not begin until the voltage drop across the electrical contacts of a switch exceeds an erosion threshold voltage. Thus, second mechanical switch 114B allows switch structure 114 to provide like new service (with an electrical pathway that has no contact resistance) up to the point of where the voltage drop across the switch (contact) resistance R exceeds the erosion threshold voltage and contact resistance begins to develop on second mechanical switch 114B. After this, switch structure 114 continues to provide the lifetime of second mechanical switch 114B.

Thus, switch structure 114 of the present invention substantially reduces the effect of contact resistance. As a result, switch structure 114 of the present invention provides a substantially longer switch lifetime for applications that are sensitive to the addition of contact resistance, and a substantially longer period of like new service (with an electrical pathway that has no contact resistance).

With respect to the opening of switch structure 114, switch structure 114 opens in the opposite manner that it was closed. As a result, when switch structure 114 opens, second mechanical switch 114B opens first. After second mechanical switch 114B has completely opened, first mechanical switch 114A opens second.

Initially, when second mechanical switch 114B opens, there is no voltage drop across the electrical contacts 116 and 118 of second mechanical switch 114B because first mechanical switch 114A is still closed. If there is no voltage drop across the electrical contacts 116 and 118 of second mechanical switch 114B, then no contact resistance can develop.

Thus, first mechanical switch 114A also protects second mechanical switch 114B from degradation due to contact resistance as second mechanical switch 114B is opening (as long as the voltage drop across the switch (contact) resistance R remains less than the erosion threshold voltage).

In the present invention, the first and second mechanical switches 114A and 114B of switch structure 114 can be implemented with conventional mechanical switches that suffer from contact resistance. In further accordance with the present invention, switch structure 114 can be implemented as a micro-electromechanical system (MEMS) device.

Figure 3:
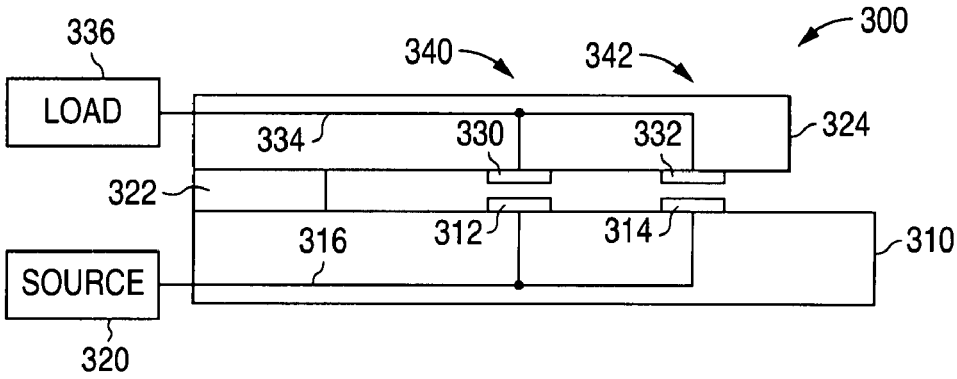
FIG. 3 is a cross-sectional view illustrating an example of a MEMS switch 300 in accordance with the present invention.

FIG. 3 shows a cross-sectional view that illustrates an example of a MEMS switch 300 in accordance with the present invention. As shown in FIG. 3, MEMS switch 300 includes a non-conducting base region 310, and spaced-apart first and second base conductive pads 312 and 314, respectively, that contact the top surface of non-conductive base region 310.

In addition, a conductive line 316 touches base region 310, and is electrically connected to the first and second base conductive pads 312 and 314, and to, for example, a voltage source 320 like AC voltage source 110. Conductive line 316 can be implemented with a conductive trace that lies in the same horizontal plane as the pads 312 and 314, or with vias that lie below and contact the pads 312 and 314 and a conductive trace that lies below and contacts the vias.

As further shown in FIG. 3, MEMS switch 300 also includes a non-conductive pillar 322 that is attached to non-conductive base region 310, and a non-conductive cantilever 324 that is attached to pillar 322 to extend out over base region 310. Further, spaced-apart first and second cantilever conductive pads 330 and 332, respectively, are attached to the bottom surface of cantilever 324 in the gap between base region 310 and cantilever 324 to be aligned with base conductive pads 312 and 314.

In addition, MEMS switch 300 includes a conductive line 334 that touches cantilever 324, and is electrically connected to the first and second cantilever conductive pads 330 and 332, and to, for example, a load 336 like load 112. Conductive line 334 can be implemented with a conductive trace that lies in the same horizontal plane as the pads 330 and 332, or with vias that lie above and contact the pads 330 and 332 and a conductive trace that lies above and contacts the vias.

In MEMS switch 300, first base conductive pad 312 and first cantilever conductive pad 330 move toward and away from each other and function as a first mechanical switch 340 that makes and breaks an electrical pathway between voltage source 320 and load 336. Further, the second base conductive pad 314 and the second cantilever conductive pad 332 move toward and away from each other and function as a second mechanical switch 342 which is connected in parallel to also make and break an electrical pathway between voltage source 320 and load 336.

Figure 4A:
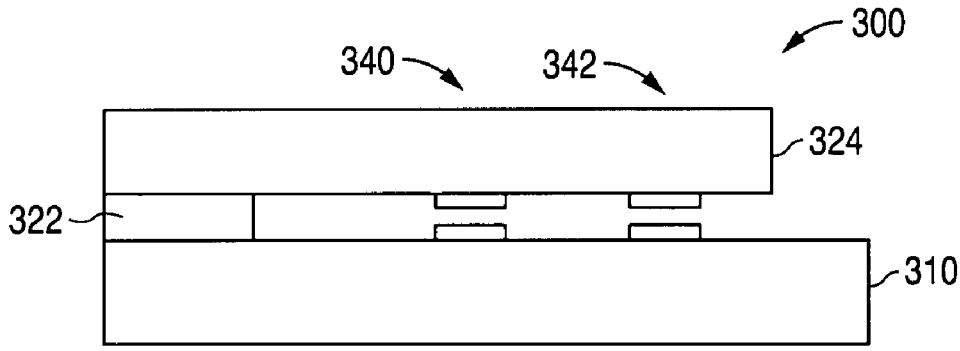
FIGS. 4A-4C are cross-sectional views illustrating the operation of MEMS switch 300 in accordance with the present invention.
Figure 4B:
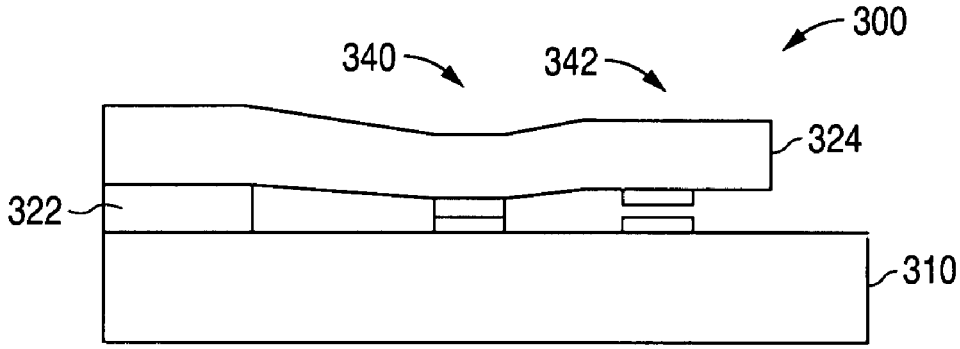
Figure 4C:
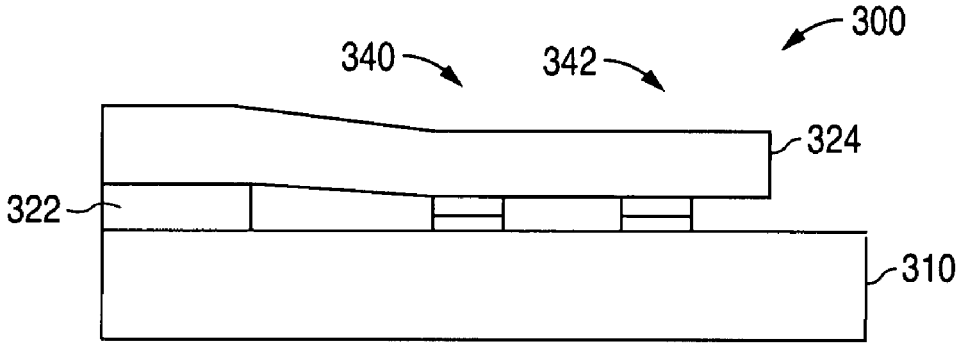

FIGS. 4A-4C are cross-sectional views that illustrate the operation of MEMS switch 300 in accordance with the present invention. MEMS switch 300 can assume one of three positions. As shown in FIG. 4A, the first of the three positions is the "open" position where the base conductive pads 312 and 314 are spaced-apart from the cantilever conductive pads 330 and 332. In this case, both the first and second mechanical switches 340 and 342 are open.

The second position, as shown in FIG. 4B, is the "partially closed" position where the first base conductive pad 312 and the first cantilever conductive pad 330 physically contact each other, while the second base conductive pad 314 and the second cantilever conductive pad 332 remain physically separated. In this case, first mechanical switch 340 is closed, while second mechanical switch 342 is open.

As shown in FIG. 4C, the third position is the "fully closed" position where both the first base conductive pad 312 and the first cantilever conductive pad 330 physically contact each other, and the second base conductive pad 314 and the second cantilever conductive pad 332 physically contact each other. In this case, both the first and second mechanical switches 340 and 342 are closed.

MEMS switch 300 can be actuated (caused to open and close) by any conventional means, such as by using electromagnetic and thermal actuation techniques. The "partially closed" position is a temporary position that occurs only momentarily as MEMS switch 300 assumes either the open position or the closed position.

FIGS. 5A-16A and 5B-16B show a series of views that illustrate a method of forming MEMS switch 300 in accordance with the present invention. FIGS. 5A-16A show a series of plan views, while FIGS. 5B-16B show a series of cross-sectional views taken along lines 5B-16B in FIGS. 5A-16A, respectively.

Figure 5A:
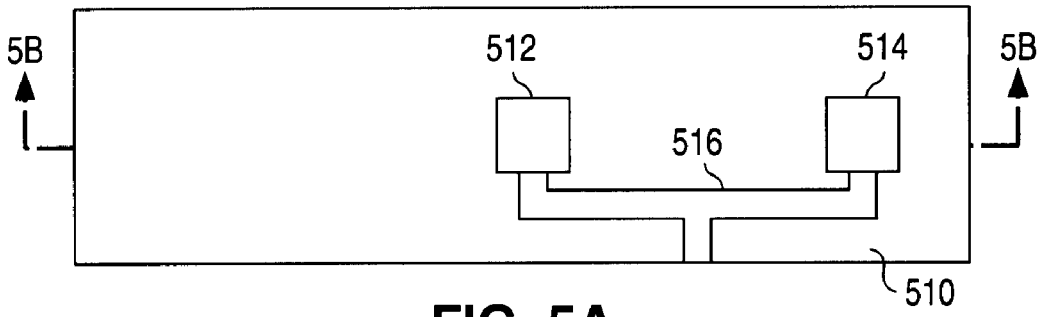
Figure 5B:
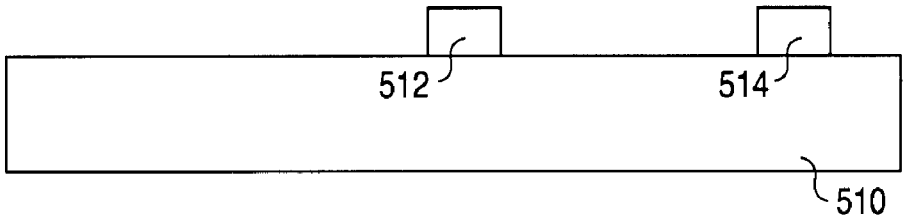

As shown in FIGS. 5A-5B, the method utilizes a conventionally formed non-conductive base region 510, and spaced-apart first and second base conductive pads 512 and 514, respectively, which contact the top surface of base region 510. In addition, a conductive (trace) line 516 is formed on base region 510, and electrically connected to the first and second base conductive pads 512 and 514.

Figure 6A:
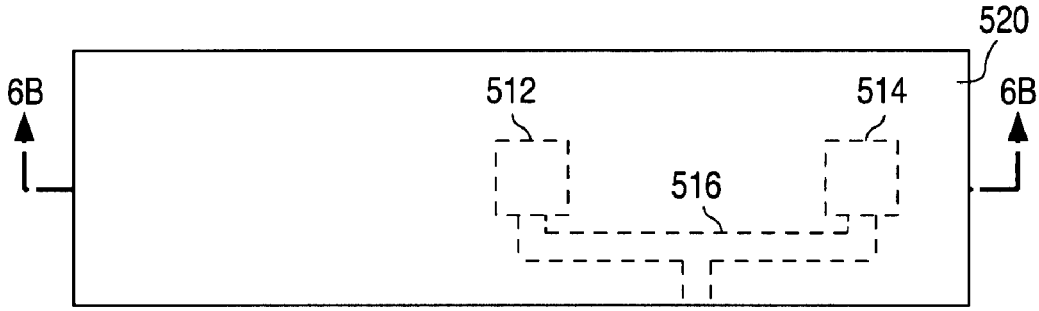
Figure 6B:
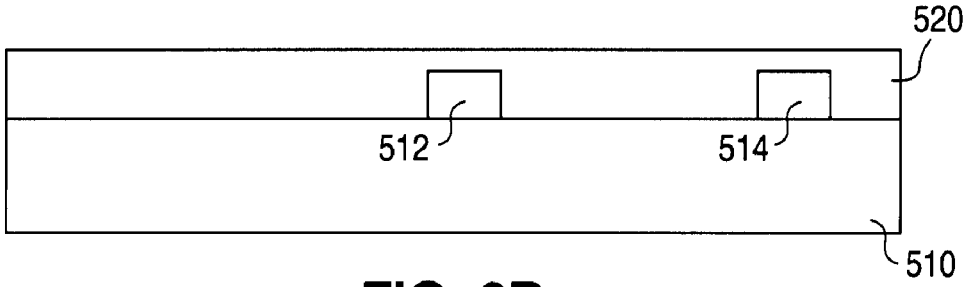

As shown in FIGS. 6A-6B, the method begins by forming and then planarizing a layer of sacrificial material 520 on base region 510, base conductive pads 512 and 514, and conductive line 516. As shown in FIGS. 6A-6B, the top surface of the layer of sacrificial material 520 lies over the top surfaces of the first and second base conductive pads 512 and 514.

Figure 7A:
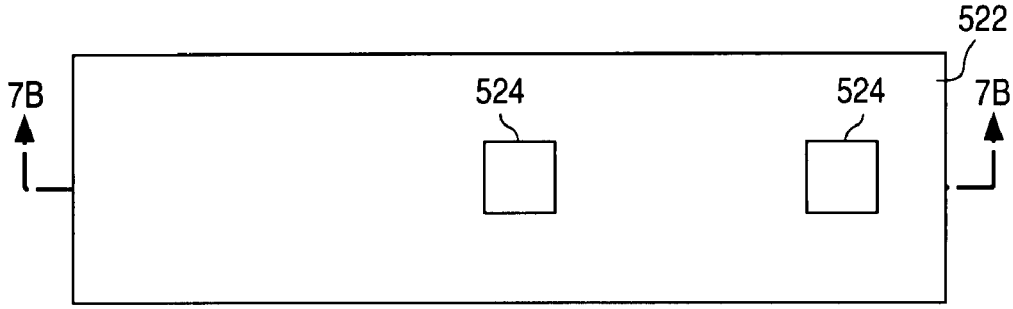
Figure 7B:
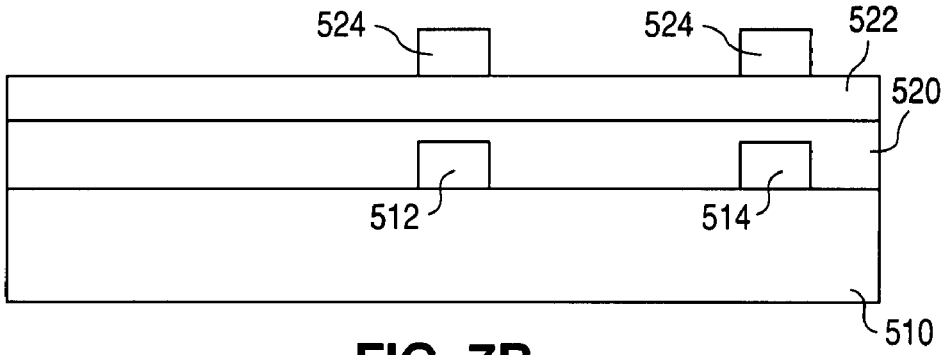
Figure 8A:
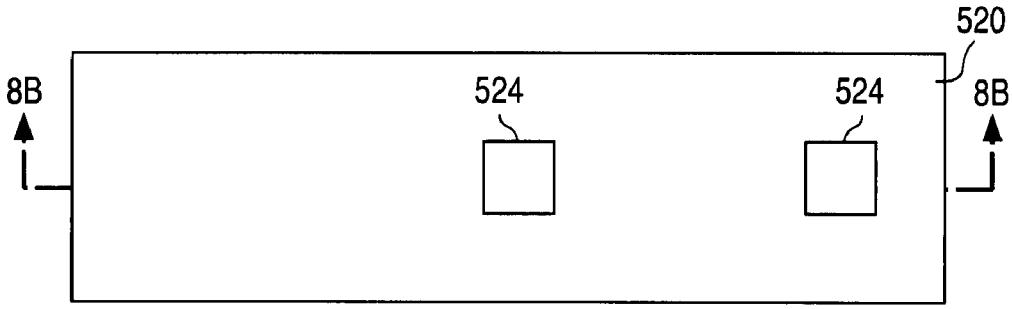
Figure 8B:
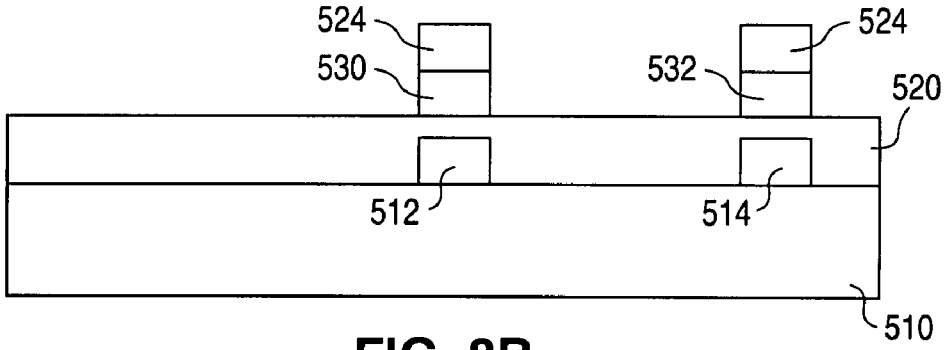

Next, as shown in FIGS. 7A-7B, a layer of conductive material 522, such as a metallic material, is deposited on the top surface of the layer of sacrificial material 520. Following this, a mask 524 is formed and patterned on the layer of conductive material 522. As shown in FIGS. 8A-8B, the exposed regions of conductive layer 522 are then etched away to form first and second cantilever conductive pads 530 and 532. Mask 524 is then removed.

Figure 9A:
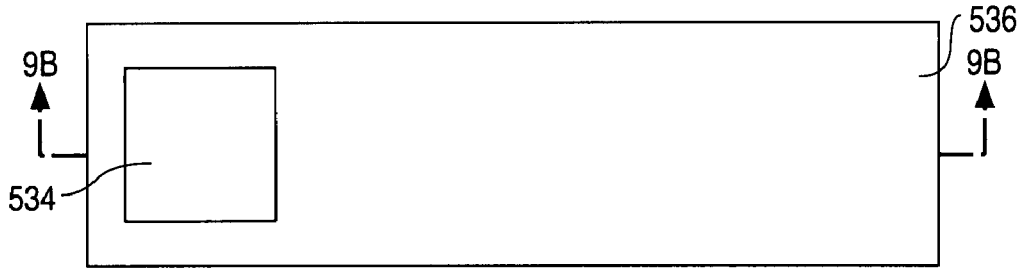
Figure 9B:
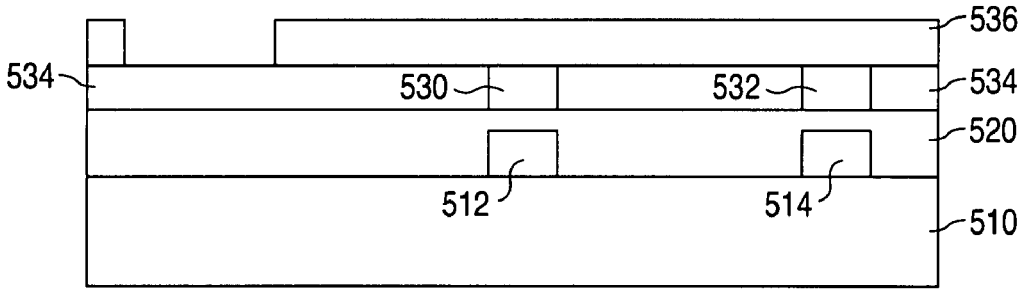

After mask 524 has been removed, as shown in FIGS. 9A-9B, a layer of sacrificial material 534 is formed on sacrificial layer 520 and cantilever conductive pads 530 and 532. Sacrificial layer 534 is then planarized until the top surfaces of the first and second cantilever conductive pads 530 and 532 have been exposed.

Figure 10A:
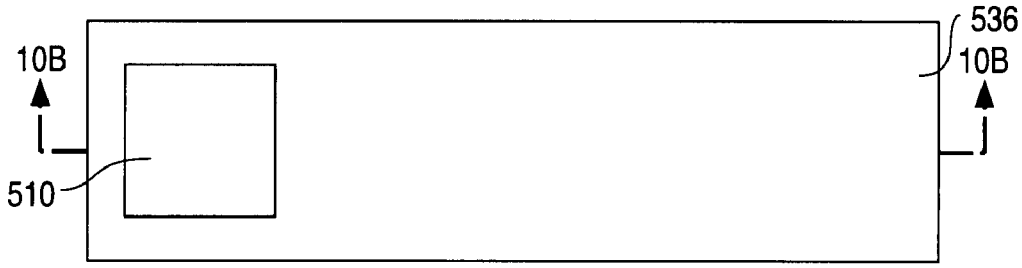
Figure 10B:
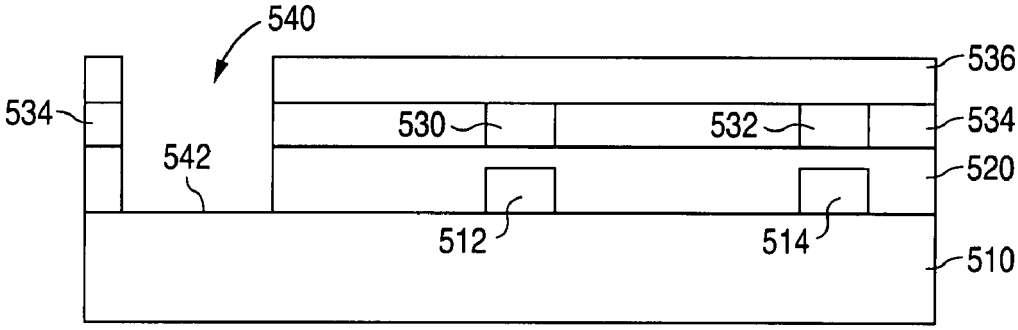

Once planarization is complete, a mask 536 is formed and patterned on sacrificial layer 534 and cantilever conductive pads 530 and 532. Following this, as shown in FIGS. 10A-10B, the exposed regions of sacrificial layer 534 and underlying sacrificial layer 520 are etched until a pillar opening 540 has been formed that exposes a pillar region 542 on the top surface of base region 510. Mask 536 is then removed.

Figure 11A:
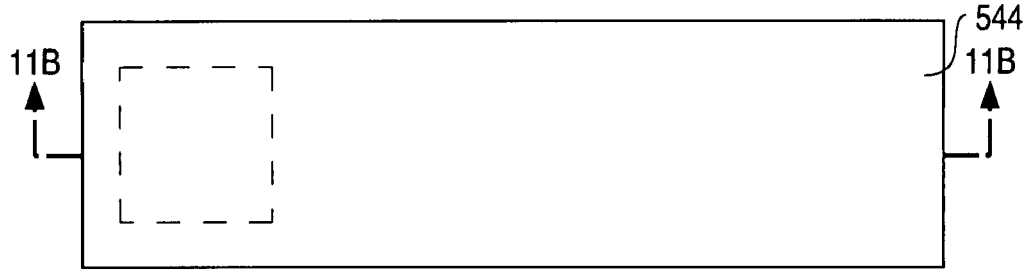
Figure 11B:
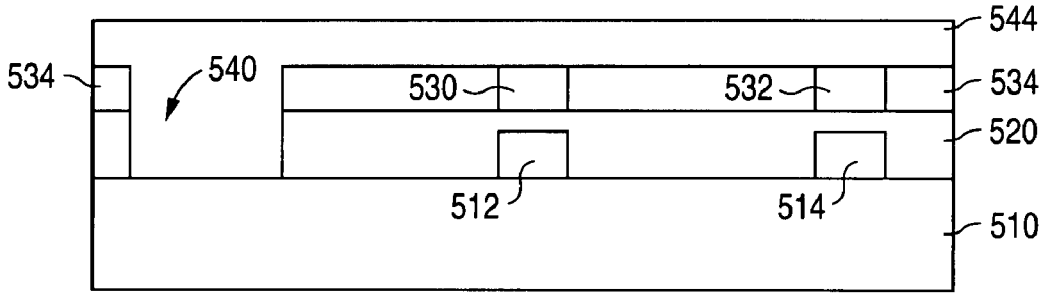

After mask 536 has been removed, as shown in FIGS. 11A-11B, a layer of non-conductive cantilever material is formed in pillar opening 540 to form a cantilever structure 544 that contacts base region 510, cantilever conductive pads 530 and 532, and sacrificial layer 534. Cantilever structure 544 is then planarized until cantilever structure 544 has reached a desired thickness.

Figure 12A:
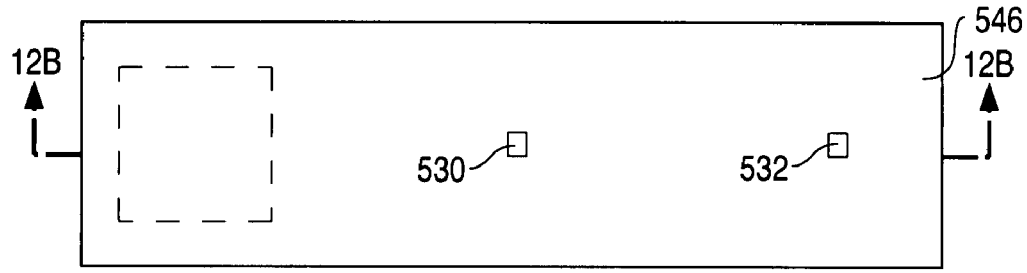
Figure 12B:
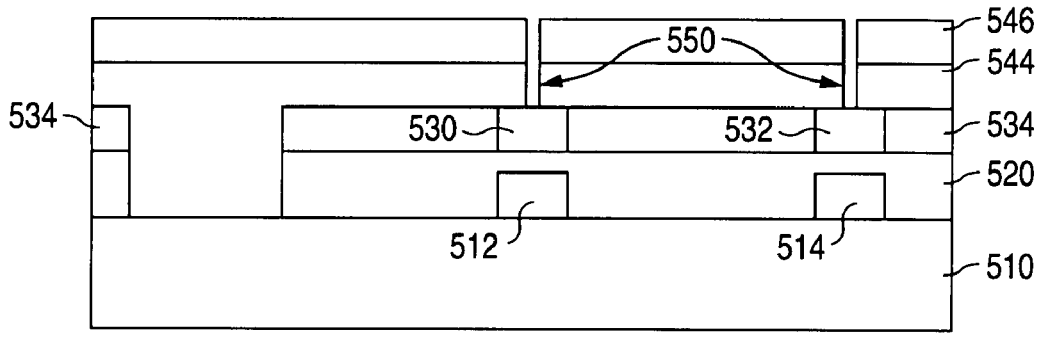

Next, as shown in FIGS. 12A-12B, a mask 546 is formed and patterned on cantilever structure 544. Following this, the exposed regions of cantilever structure 544 are etched until via openings 550 have been formed in cantilever structure 544 that expose regions on the top surface of conductive pads 530 and 532. Mask 546 is then removed.

Figure 13A:
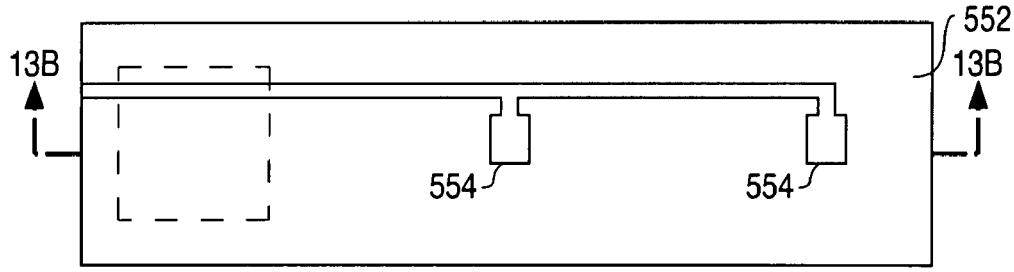
Figure 13B:
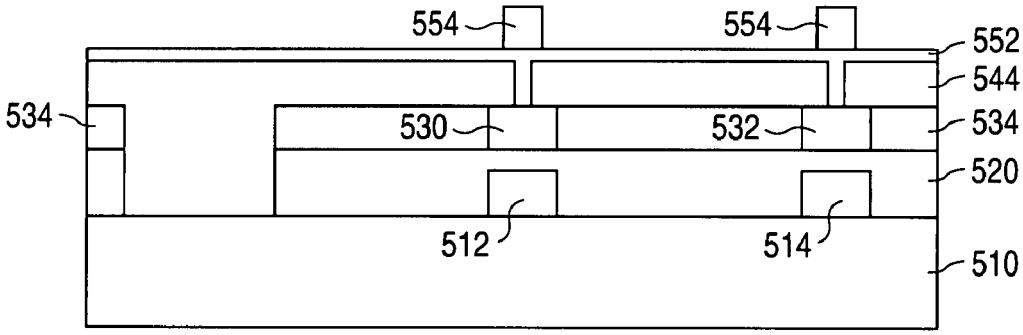

After mask 546 has been removed, as shown in FIGS. 13A-13B, a layer of conductive material 552 is formed on cantilever structure 544 to fill up via openings 550 and make electrical connections with conductive pads 530 and 532. Once conductive layer 552 has been formed, a mask 554 is formed and patterned on conductive layer 552.

Figure 14A:
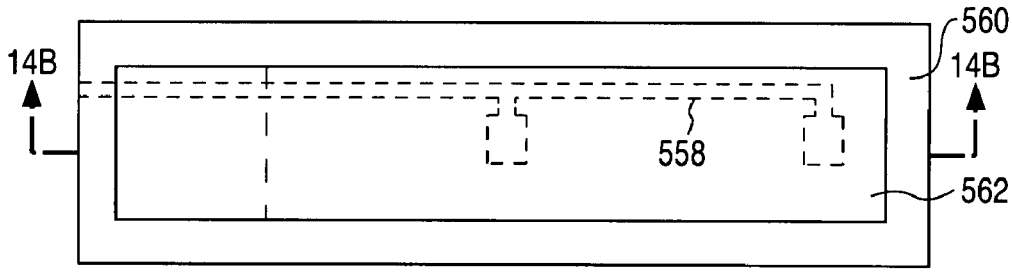
Figure 14B:
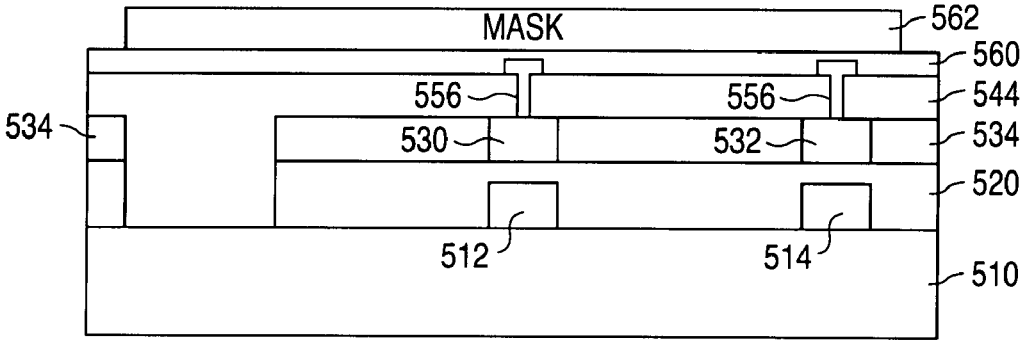

Following this, as shown in FIGS. 14A-14B, the exposed regions of conductive layer 552 are etched to form vias 556 in cantilever structure 544 and conductive traces 558 on cantilever structure 544. Mask 554 is then removed. Once mask 554 has been removed, a layer of sealant material 560 is formed on cantilever structure 544 and traces 558, and then planarized. Next, a mask 562 is formed and patterned on sealant layer 560.

Figure 15A:
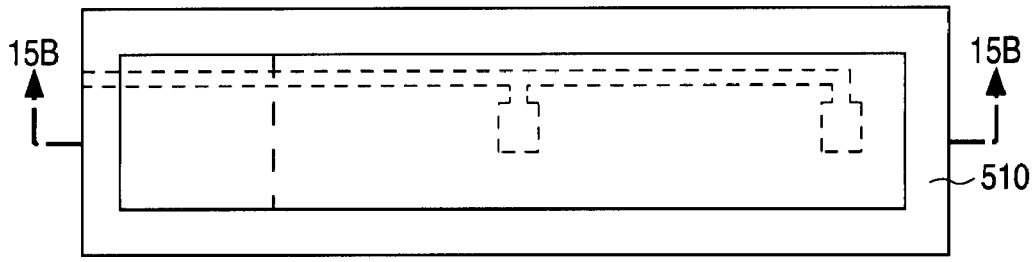
Figure 15B:
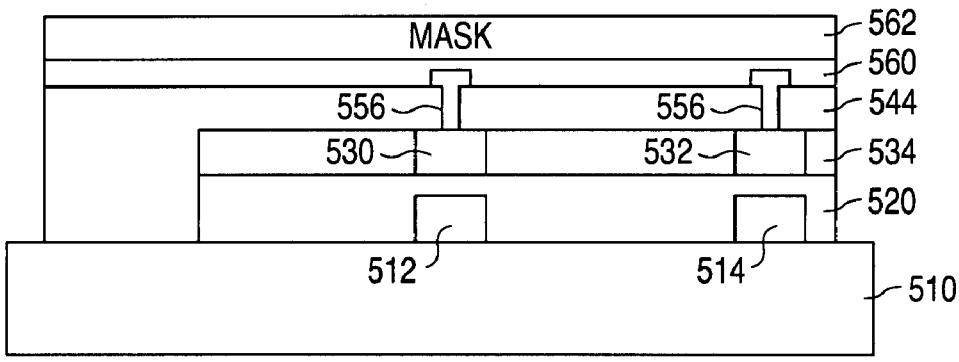
Figure 16A:
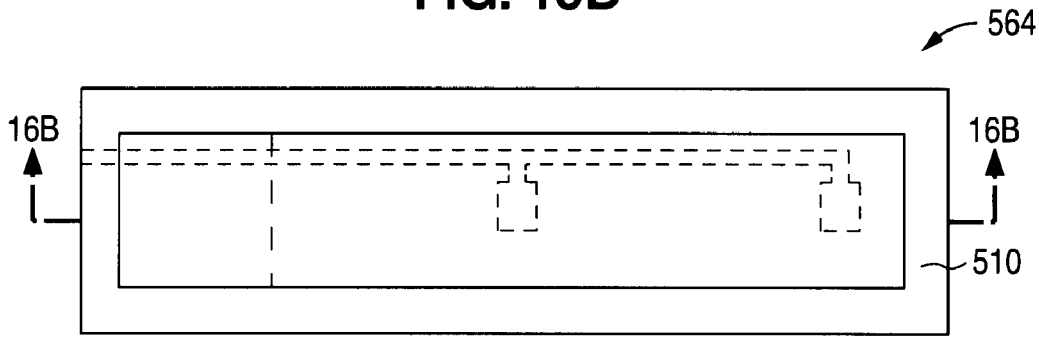
Figure 16B:
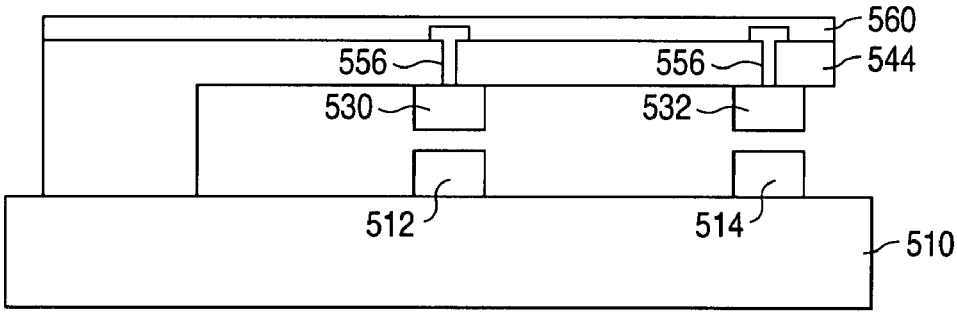

Following this, as shown in FIGS. 15A-15B, the exposed regions of sealant layer 560, cantilever structure 544, and sacrificial layers 520 and 534 are etched until the top surface of base region 510 is exposed. Mask 562 is then removed. Once mask 562 has been removed, the structure is wet etched to remove sacrificial layers 520 and 534 to produce a switch 564 as shown in FIGS. 16A-16B.

As noted above, MEMS switch 300 can be actuated (caused to open and close) by any conventional means, such as by using electromagnetic and thermal actuation techniques. The processing steps required to fabricate a conventionally actuated cantilever structure are well known in the art.

It should be understood that the above descriptions are examples of the present invention, and that various alternatives of the invention described herein may be employed in practicing the invention. Thus, it is intended that the following claims define the scope of the invention and that structures and methods within the scope of these claims and their equivalents be covered thereby.

What is claimed is:

1. A semiconductor structure comprising:

a pair of cantilever pads, the pair of cantilever pads being conductive and spaced apart from each other, and lying over and spaced apart from a semiconductor region, the semiconductor region being non-conductive and having a top surface;

a cantilever structure, the cantilever structure being non-conductive and having a pillar that touches the semiconductor region and a cantilever that touches the pillar, the cantilever extending out over and being spaced apart from the semiconductor region, the cantilever having a top surface and a bottom surface, the bottom surface touching the pair of cantilever pads; and a cantilever line that touches the cantilever, the cantilever line being conductive, spaced apart from the top surface of the semiconductor region, and electrically connected to the pair of cantilever pads.

2. The semiconductor structure of claim 1 wherein:

the pair of cantilever pads includes a first cantilever pad and a second cantilever pad; and a region of the bottom surface of the cantilever lies between the first cantilever pad and the second cantilever pad.

3. The semiconductor structure of claim 2 wherein the cantilever line touches the top surface of the cantilever.

4. The semiconductor structure of claim 3 wherein the cantilever line lies directly over the pillar.

5. The semiconductor structure of claim 2 and further comprising:

a pair of base pads, the pair of base pads being conductive and spaced apart from each other, and touching the top surface of the semiconductor region; and a base line that touches the semiconductor region, the base line being electrically connected to the pair of base pads.

6. The semiconductor structure of claim 5 wherein:

the pair of base pads includes a first base pad and a second base pad; and a region of the top surface of the semiconductor region lies between the first base pad and the second base pad.

7. The semiconductor structure of claim 6 wherein the cantilever is flexible such that as the cantilever moves towards the semiconductor region the first base pad and the first cantilever pad make an electrical connection before the second base pad and the second cantilever pad make an electrical connection.

8. The semiconductor structure of claim 6 wherein the first cantilever pad is vertically aligned with the first base pad, and the second cantilever pad is vertically aligned with the second base pad.

9. A method of forming a semiconductor structure comprising:

forming a pair of cantilever pads, the pair of cantilever pads being conductive and spaced apart from each other, and lying over and spaced apart from a semiconductor region, the semiconductor region being non-conductive and having a top surface;

forming a cantilever structure, the cantilever structure being non-conductive and having a pillar that touches the semiconductor region and a cantilever that touches the pillar, the cantilever extending out over and being spaced apart from the semiconductor region, the cantilever having a top surface and a bottom surface, the bottom surface touching the pair of cantilever pads; and forming a cantilever line that touches the cantilever, the cantilever line being conductive, spaced apart from the top surface of the semiconductor region, and electrically connected to the pair of cantilever pads.

10. The method of claim 9 wherein:

the pair of cantilever pads includes a first cantilever pad and a second cantilever pad; and a region of the bottom surface of the cantilever lies between the first cantilever pad and the second cantilever pad.

11. The method of claim 10 wherein the cantilever line touches the top surface of the cantilever.

12. The method of claim 11 wherein the cantilever line lies directly over the pillar.

13. The method of claim 10 wherein forming the pair of cantilever pads includes:

forming a first sacrificial layer, the first sacrificial layer touching and lying over the semiconductor region and a pair of base pads, the pair of base pads being conductive and spaced apart;

forming a conductive layer on the first sacrificial layer, the conductive layer being spaced apart from the pair of base pads; and etching the conductive layer to form the pair of cantilever pads.

14. The method of claim 13 wherein:

the pair of base pads includes a first base pad and a second base pad; and a region of the top surface of the semiconductor region lies between the first base pad and the second base pad.

15. The method of claim 14 wherein the first cantilever pad is vertically aligned with the first base pad, and the second cantilever pad is vertically aligned with the second base pad.

16. The method of claim 13 wherein forming the cantilever structure includes:

forming a second sacrificial layer, the second sacrificial layer touching the first sacrificial layer and the pair of cantilever pads;

etching the second sacrificial layer and the first sacrificial layer to form an opening that exposes the top surface of the semiconductor region; and forming a non-conductive material, the non-conductive material touching the top surface of the semiconductor region exposed by the opening, the top surface of the second sacrificial layer, and the pair of conductive pads.

17. The method of claim 16 wherein forming the cantilever line includes:

forming a pair of openings in the non-conductive material, the pair of openings exposing the pair of cantilever pads;

forming a conductive material, the conductive material touching the pair of cantilever pads exposed by the pair of openings, and a top surface of the non-conductive material; and etching the conductive material to form the cantilever line.

18. The method of claim 17 and further comprising removing the first sacrificial layer and the second sacrificial layer.

* * * * *

UNITED STATES PATENT AND TRADEMARK OFFICE

CERTIFICATE OF CORRECTION

PATENT NO. : 7,754,986 B1
APPLICATION NO. : 11/711523
DATED : July 13, 2010
INVENTOR(S) : Trevor Niblock et al.

It is certified that error appears in the above-identified patent and that said Letters Patent is hereby corrected as shown below:

Column 3, line 4, delete "second mechanical switch 1146", and replace with --second mechanical switch 114B--.

Signed and Sealed this

Seventh Day of September, 2010

David J. Kappos

David J. Kappos
*Director of the United States Patent and Trademark Office*